United States Patent [19]

Mouissie

[11] Patent Number: 4,871,320

[45] Date of Patent: Oct. 3, 1989

[54] PIN HOLDER

[75] Inventor: Bob Mouissie, Berlicum, Netherlands

[73] Assignee: E. I. Du Pont de Nemours and Company, Wilmington, Del.

[21] Appl. No.: 254,181

[22] Filed: Oct. 6, 1988

[30] Foreign Application Priority Data

Oct. 16, 1987 [DE] Fed. Rep. of Germany ... 8713932[U]

[51] Int. Cl.[4] ..... H01R 9/09

[52] U.S. Cl. ..... 439/78; 439/598; 439/701; 439/712

[58] Field of Search ..... 439/76, 78, 80–82, 439/594, 598, 603, 701, 709–713, 722

[56] References Cited

U.S. PATENT DOCUMENTS 4,391,482 7/1983 Czeschka ..... 439/78
4,655,515 4/1987 Hamsher, Jr. et al. ..... 439/701
4,709,976 12/1987 Nakama et al. ..... 439/712
4,721,478 1/1988 Sonobe ..... 439/598
4,762,508 8/1988 Tengler et al. ..... 439/712

*Primary Examiner*—P. Austin Bradley
*Attorney, Agent, or Firm*—Barry Estrin

[57] ABSTRACT

A pin holder for a separable electronic plug connection wherein a number of resilient lips are formed on the holder. The lips are provided at their free ends with an inwardly protruding hook-shaped part. The pin holder has a pin carrier located therein. The pin carrier has outwardly, directed protruding parts formed thereon which, in the assembled state, engage behind the hook shaped parts which have been provided with obliquely running contact surfaces. At least one shoulder inside the holder preferably forms stop means. The pin holder is further provided with openings in an intermediate wall through which pins can extend.

4 Claims, 1 Drawing Sheet

PIN HOLDER

BACKGROUND OF THE INVENTION

The invention relates to a pin holder for a separable electronic plug connection, comprising a holder having located in it a pin carrier provided with plug-on pins. Such a pin holder is generally known.

In the case of the known pin holder, the pin carrier forms a whole with the holder, so that in the production of the pin holder from a plastic material, the plug-on pins have to be inserted into the injection-moulding machine or first the holder has to be produced with pin carrier provided with openings and thereafter the pins have to be inserted into the openings. The pins are in this case provided in advance with a surface coating, for example of tin-lead, by means of a galvanic treatment of the pins.

However, for an application in today's auto-electronics in particular, it is of importance that the surface coatings are not the same for all pins but differ from each other in connection with the much smaller control voltages or currents. This means that in manufacturing of the known pin holder the various pin types have to be inserted very precisely into their respective positions in the injection-moulding machine or that, in the subsequent insertion of the pins into the openings of the pin carriers, this insertion process has to be carried out in steps, a pin or pins of a certain type being inserted in each step.

The methods of production described above are complex and expensive.

SUMMARY OF THE INVENTION

The invention aims at creating an improved pin holder of the said type which can be assembled less expensively.

This object is achieved in the case of the pin holder according to the invention by the pin carrier having been fixed essentially detachably in the holder by means of fixing elements.

Preferably, in this case the fixing elements are formed by a number of resilient lips which are formed on the holder and are provided at their free ends with an inwardly protruding hook-shaped part, and by outwardly directed protruding parts which are formed on the pin carrier and, in the assembled state, engage behind the hook-shaped parts, the said one parts being provided with obliquely running contact surfaces which can interact with the other parts in such a way that, when the pin carrier is pushed into the holder, the resilient lips are initially pushed away sideways and thereafter, due to their spring force, engage with their hook-shaped parts behind the protruding parts, and stopping means have been fitted which prevent the pin carrier being pushed further into the holder.

In the case of a pin holder designed in this way according to the invention, any desired, previously produced or commercially available pin carrier can be inserted into the holder in a very simple way, so that a pin holder having the pins desired with regard to their shape length, number or surface coating can be assembled very quickly as required.

The resilient lips are advantageously formed by wall parts of the holder, which are limited by means of slits made in the wall concerned of the holder.

The stopping means may advantageously be formed by at least one shoulder inside the holder, formed on the wall of the latter, against which shoulder or shoulders the upper side of the pin carrier bears.

In the holder there may be an intermediate wall which is provided with openings through which the pins extend, as a result of which the depth of insertion of the plug interacting with the pin holder is limited. For production engineering reasons, this intermediate wall is preferably interrupted opposite the resilient lips.

BRIEF DESCRIPTION OF THE DRAWINGS

The invention is explained in more detail with reference to the drawing, in which.

DETAILED DESCRIPTION OF THE INVENTION

Figure 1:
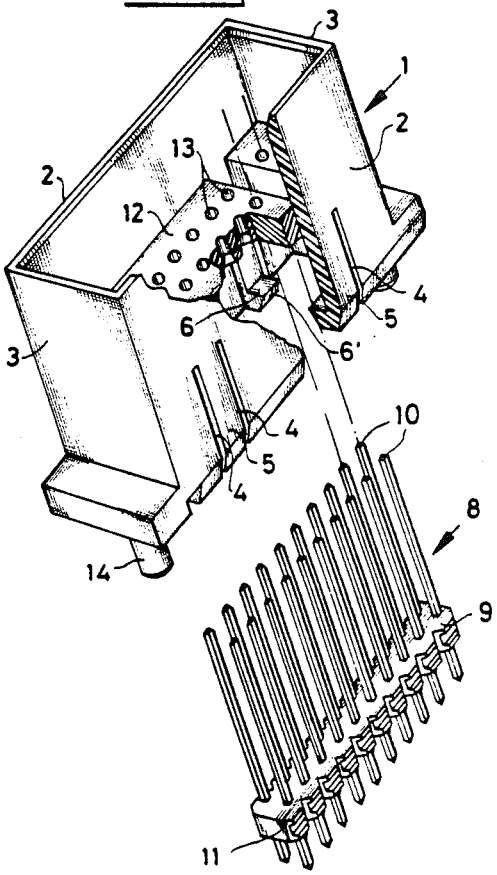
FIG. 1 shows in perspective a pin holder according to the invention and a pin carrier to be inserted therein.

As shown in the drawing, the pin holder comprises a holder 1 of rectangular shape with longitudinal walls 2 and transverse walls 3. In the longitudinal walls 2, slits 4 have been made, so that the wall parts 5 limited by these slits 4 form resilient lips, these resilient lips 5 being provided with hook-shaped parts 6 with contact surfaces 6'. The transverse walls 3 are provided at their lower ends with a shoulder 7.

Figure 3:
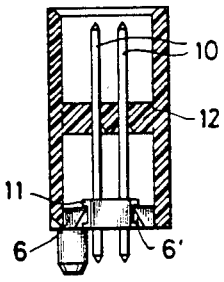
FIG. 3 shows a cross-section of the pin holder according to FIG. 2

The pin carrier 8 consists of the actual carrier 9, into which a series of pins 10 has been inserted. On the longitudinal sides, the carrier is provided with protruding parts 11, which can engage behind the hook-shaped parts 6, as shown in FIG. 3, when the pin carrier 8 is pressed into the holder 1, until the upper side of the carrier 9 bears against the shoulders 7.

Figure 2:
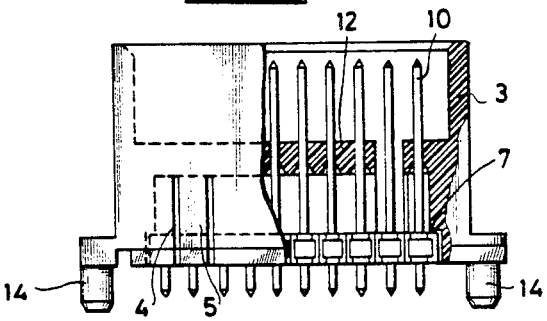
FIG. 2 shows the pin holder according to FIG. 1, in assembled state in side view and partially in longitudinal cross-section.

In the holder 1, an intermediate wall 12 is fitted, which is interrupted opposite the resilient lips 5 and in which a series of openings 13 are formed, through which the pins 10 extend in the assembled state shown in FIG. 2.

Furthermore, the holder 2 is provided with positioning pins 14, by means of which pins the assembled pin holder can be positioned, for example, on a circuit board.

Figure 4:
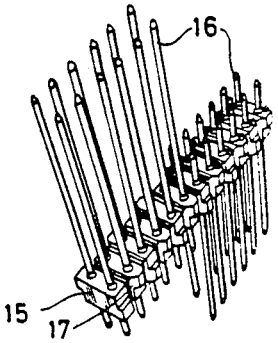
FIG. 4 shows another type of the pin carrier which can be fixed in the pin holder.

In FIG. 4, another type of pin carrier 15 with pins 16 is shown, which likewise can be fixed by means of the hook-shaped parts 6 in the holder 1, the protruding parts 17 formed on the carrier 16 engaging behind the hook-shaped parts 6.

I claim:

1. A pin holder for a separable electronic plug connection, comprising a holder having located therein a pin carrier provided with a plurality of pins and an intermediate wall which is provided with openings through which the pins extend, said pin carrier detachably fixed in the holder by means of fixing elements, said fixing elements having a plurality of resilient lips which are formed on the holder and are provided at their free ends with inwardly protruding hook-shaped parts, and further including outwardly directed protruding parts which are formed on the pin carrier and, in the assembled state, engage behind the hook-shaped parts, said hook-shaped parts being provided with obliquely running contact surfaces which can interact with said protruding parts in such a way that, when the pin carrier is pushed into the holder, the resilient lips are initially pushed away sideways and thereafter, due to their spring force, engage with their hook-shaped parts behind the protruding parts, said holder further including stopping means to prevent the pin carrier from being pushed further into the holder.

2. A pin holder according to claim 1, wherein the resilient lips are formed by wall parts of the holder, which are limited by means of slits made in the wall of the holder.

3. A pin holder according to claim 1, wherein said stopping means are formed by at least one shoulder inside the holder, formed on the wall of said holder, against which shoulder the upper side of the pin carrier bears.

4. A pin holder according to claim 1, wherein the intermediate wall is interrupted opposite the resilient lips.

* * * * *